US006431970B2

(12) United States Patent
Eberhard

(10) Patent No.: US 6,431,970 B2
(45) Date of Patent: Aug. 13, 2002

(54) SANDING PAD FOR MANUALLY OPERATABLE GRINDER

(75) Inventor: Lang Eberhard, Stuttgart (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/898,390

(22) Filed: Jul. 3, 2001

(30) Foreign Application Priority Data

Jul. 6, 2000 (DE) ..... 100 32 992

(51) Int. Cl.[7] ..... B24D 17/00

(52) U.S. Cl. ..... 451/490; 451/538; 451/539; 451/548

(58) Field of Search ..... 451/540, 548, 451/550, 526, 539, 489, 490, 494, 344, 357, 359, 538

(56) References Cited

U.S. PATENT DOCUMENTS 1,353,966 A * 9/1920 Lorenz ..... 451/494
3,243,833 A * 4/1966 Hencken ..... 451/490
3,522,681 A * 8/1970 Lampert ..... 451/490
3,527,001 A * 9/1970 Kleemeier et al. ..... 451/490
3,808,753 A * 5/1974 Maran ..... 451/490
4,490,948 A * 1/1985 Hanstein et al. ..... 451/490
5,309,682 A * 5/1994 Gutknecht et al. ..... 451/490
6,059,644 A * 5/2000 Manor et al. ..... 451/494
6,261,958 B1 * 7/2001 Crevasse et al. ..... 451/494

* cited by examiner

*Primary Examiner*—M. Rachuba
(74) *Attorney, Agent, or Firm*—Sidley Austin Brown & Wood, LLP

(57) ABSTRACT

A sanding pad with a circular cross section for a manually operable grinding device has one 'surface with means (2) for connection to the grinding device. An opposite surface (6) forms a contacting surface (5) for guiding an abrasive. The contacting surface (5) is provided with radially extending grooves (1), which are constructed open towards the contacting surface (5), in order to increase the abrading performance of the sanding pad (2).

7 Claims, 1 Drawing Sheet

SANDING PAD FOR MANUALLY OPERATABLE GRINDER

BACKGROUND OF THE INVENTION

The invention relates to a sanding pad with a circular cross section for a manually operable grinding device with means for holding the grinding device at one surface and with a contacting surface on the opposite surface for guiding an abrasive, which is connected detachably with the contacting surface by means of a connecting medium.

Sanding pads of the above-mentioned type are used as holding and guiding means for the abrasive used. The abrasive may consist, for example, of a sheet-like backing, which is coated with abrasive material. A bonding medium, applied at the sanding pad, combines the abrasive used with the sanding pad. By means of a driving device, the sanding pad is set in motion and transfers this motion to the abrasive. As a result of the movement, the abrasive material, aligned against the surface to be worked, abrade a portion of the surface to be worked. The movement, for example, is rotary.

A sanding pad of the aforementioned type is known, for example, from the EP-0745019. It has a circular cross section and is provided at one surface with means for accommodating the grinding device. On the opposite surface, the known sanding pad has a contacting surface for guiding an abrasive, the abrasive being bound to the contacting surface detachably by a bonding medium.

The low abrading performance is a disadvantage of the known solution. In order to obtain a higher abrading performance, the known sanding pad, for example, can be acted upon with a higher rotational speed or a higher contacting pressure. As a result of this reaction, however, the wear of the abrasive used is greatly accelerated, and this has a negative effect on the service life of the abrasive used.

SUMMARY OF THE INVENTION

It is a primary object of the present invention to provide a sanding pad for a manually operable grinder, which has a higher abrading performance without at the same time shortening the service life of the abrasive used.

Pursuant to the invention, this objective is accomplished owing to the fact that the sanding pad has radially extending grooves, which are arranged open towards the contacting surface, so that a plurality of radially extending edges are formed on the contacting surface. As a result, there is a high local increase in the surface pressure in the region of the edges, which leads to an increase in the abrasive performance. However, since the surface pressure is increased only locally, a shortening of the service life is avoided.

Advantageously, the grooves extend in a straight or rectilinear line, in order to achieve as uniform an abrasive performance as possible and a uniform distribution of the abraded material.

Furthermore, adjacent grooves are preferably disposed at an angle of 10° to 60° to one another, in order to utilize the contacting surface well. In addition, excessive heating of the abrasive used is avoided by the distance between adjacent grooves and especially of adjacent edges.

Preferably, adjacent grooves are disposed at an angle of 15° to one another, so that the available contacting surface is used optimally and the abrasive used is not overheated.

Perpendicularly to the contacting surface, advantageously the grooves have a depth corresponding to 0.005 to 0.07 times the diameter of the contacting surface of the sanding pad. If the grooves are too deep, a disadvantageous weakening of the stability of the sanding pad will result. Grooves with an inadequate depth have a negative effect on the abrading performance of the sanding pad.

Advisably, the grooves have a radial distance inwardly from the outer periphery of the contacting surface, in order to maintain the stability of the cross members, formed by the grooves.

Preferably, the distance from the outer periphery corresponds to 0.01 to 0.05 times the diameter of the contacting surface the sanding pad. The smaller the distance that is selected, the greater is the abrasion performance of the sanding pad; at the same time, however, the stability decreases.

Advantageously, the length of the grooves corresponds to 0.1 to 0.4 times the diameter of the contacting surface grinding pad, to make sufficient space available for access to a locking device for the accommodating means.

At least the radially extending walls of the grooves extend obliquely with formation of a width increasing toward the contacting surface. Advisably, the walls of the grooves diverge in alignment towards the contacting surface. At least the radially extending wall, trailing in the direction of rotation, has this distinguishing feature, in order to achieve a maximum stability of the edges. The opposite edge does not need to have this distinguishing feature, since the load on this edge is significantly less.

In order to permit the grinding medium to be installed and dismantled easily, the connecting means are advantageously formed as Velcro strip fasteners.

Moreover, the sanding pad has a reinforcement extending over its periphery, especially a ring of a material stronger than that of the sanding pad in the remaining area of the contacting surface. By these means, the dimensional stability of the sanding pad is increased, especially in the peripheral area.

The various features of novelty which characterize the invention are pointed out with particularity in the claims annexed to and forming a part of this disclosure. For a better understanding of the invention, its operating advantages and specific objects attained by it use, references should be had to the drawings and description matter in which there are illustrated and described preferred embodiments of the invention.

BRIEF DESCRIPTION OF THE DRAWING

The invention is described in greater detail below by means of an example. In the drawing.

DETAILED DESCRIPTION OF THE INVENTION

Figure 1:
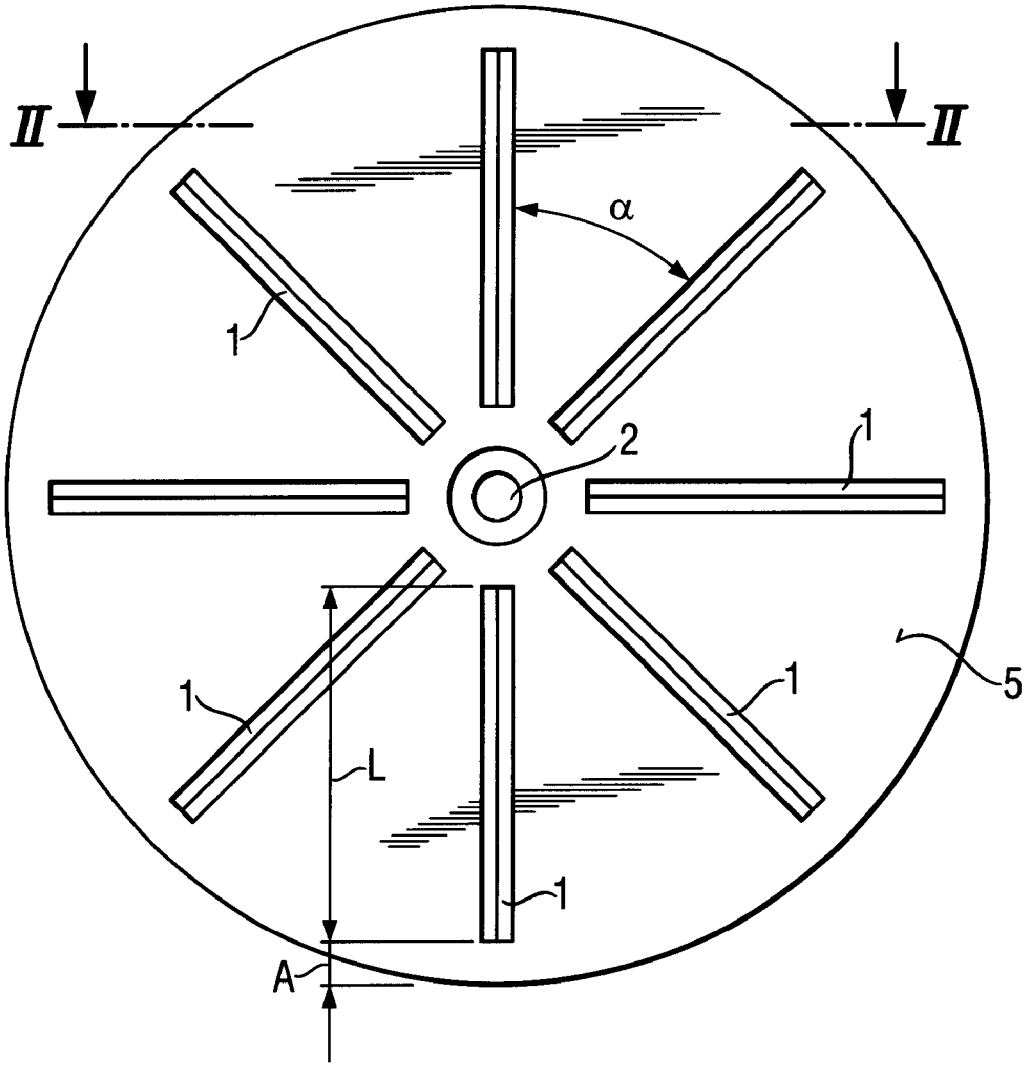
FIG. 1 shows an inventive sanding pad in plan view of the contacting surface guiding the abrasive.
Figure 2:
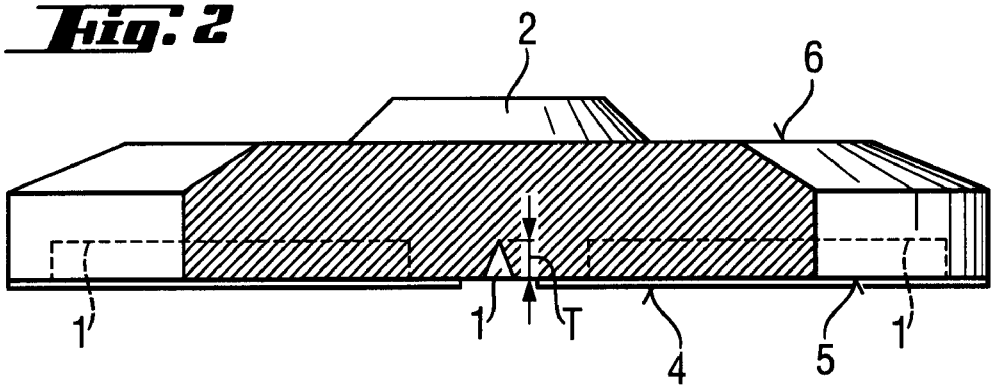
FIG. 2 displays the sanding pad, shown in FIG. 1, in cross section along the line II—II in FIG. 1.

In FIGS. 1 and 2, a sanding pad is shown with a circular cross section for a manually operable grinder, not shown. The circular cross section has a central axis . On a first surface 6 extending transversely of the central axis, the sanding pad has means 2 for connection to the grinder. A second or contacting surface 5 for guiding an abrasive, which can be connected with a Velcro strip fastener 4, is disposed opposite the first surface.

As shown particularly in FIG. 2, the sanding pad has grooves 1, which extend radially relative to the central axis are formed open towards the contacting surface 5 and extend rectilinearly. The grooves 1 have a length L, a depth T, and a distance A inwardly from the outer periphery of the sanding pad. Adjacent grooves are disposed at an angle α of 45° to one another. The radially extending walls of the grooves 1 are arranged obliquely in alignment from one another in the direction of the contacting surface.

The depth T of the groove 1 corresponds to 0.005 to 0.07 times, the length L to 0.1 to 0.4 times and the distance A from the outer periphery to 0.01 to 0.05 times the diameter of the contracting surface of the grinding disk. The sanding pad consists, for example, at least partly of polyurethane foam.

The various features of novelty which characterize the invention are pointed out with particularity in the claims annexed to and forming a part of this disclosure. For a better understanding of the invention, its operating advantages and specific objects attained by it use, references should be had to the drawings and description matter in which there are illustrated and described preferred embodiments of the invention.

What is claimed is:

1. A sanding pad having a central axis and a circular cross section extending transversely of the central axis for use on a manually operable grinding tool, said sanding pad having a first surface (6) and an opposite second surface (5) each extending transversely of the central axis and said second surface having a diameter, means (2) on said first surface for attaching said sanding pad to the grinding tool, said second surface (6) arranged to mount an abrasive material detachably secured by a securing medium (4) to the second surface (6), and said second surface having radially extending grooves (1) therein open at the second surface (5), wherein said grooves (1) are spaced apart from one another at an angle (α) in the range of 10° to 60° with the spaces therebetween increasing radially outwardly from the central axis.

2. A sanding pad, as set form in claim 1, wherein said grooves (1) are rectilinear.

3. A sanding pad, as set forth in claim 1, wherein said grooves (1) are spaced apart from one another at an angle (α) of 15°.

4. A sanding pad having a central axis and a circular cross section extending transversely of the central axis for use on a manually operable grinding tool, said sanding pad having a first surface (6) and an opposite second surface (5) each extending transversely of the central axis and said second surface having a diameter, means (2) on said first surface for attaching said sanding pad to the grinding tool, said second surface (6) arranged to mount an abrasive material detachably secured by a securing medium (4) to the second surface (6), and said second surface having radially extending grooves (1) therein open at the second surface (5), wherein said grooves (1), perpendicular to said second surface have a depth (T) in the range of 0.005 to 0.07 times the diameter of said second surface.

5. A sanding pad having a central axis and a circular cross section extending transversely of the central axis for use on a manually operable grinding tool, said sanding pad having a first surface (6) and an opposite second surface (5) each extending transversely of the central axis and said second surface having a diameter, means (2) on said first surface for attaching said sanding pad to the grinding tool, said second surface (6) arranged to mount an abrasive material detachably secured by a securing medium (4) to the second surface (6), and said second surface having radially extending grooves (1) therein open at the second surface (5), wherein said grooves (1) are spaced radially inwardly from an outer periphery of said second surface (5) by a dimension (A), wherein the dimension (A) is in the range of 0.01 to 0.05 times the diameter of said second surface (5).

6. A sanding pad having a central axis and a circular cross section extending transversely of the central axis for use on a manually operable grinding tool, said sanding pad having a first surface (6) and an opposite second surface (5) each extending transversely of the central axis and said second surface having a diameter, means (2) on said first surface for attaching said sanding pad to the grinding tool, said second surface (6) arranged to mount an abrasive material detachably secured by a securing medium (4) to the second surface (6), and said second surface having radially extending grooves (1) therein open at the second surface (5), wherein said grooves (1) have a radial length (L) in the range of 0.1 to 0.4 times the diameter of the second surface (5) of said sanding pad.

7. A sanding pad having a central axis and a circular cross section extending transversely of the central axis for use on a manually operable grinding tool, said sanding pad having a first surface (6) and an opposite second surface (5) each extending transversely of the central axis and said second surface having a diameter, means (2) on said first surface for attaching said sanding pad to the grinding tool, said second surface (6) arranged to mount an abrasive material detachably secured by a securing medium (4) to the second surface (6), and said second surface having radially extending grooves (1) therein open at the second surface (5), wherein said grooves (1) have radially extending side walls inwardly of the second surface (5) extending obliquely to one another and have a width therebetween increasing toward the second surface.

* * * * *